US005409594A

United States Patent [19]

Al-Jiboory et al.

[11] Patent Number: 5,409,594

[45] Date of Patent: Apr. 25, 1995

[54] ULTRASONIC AGITATOR

[75] Inventors: Muhammed M. Al-Jiboory; Richard R. Timewell, both of Vancouver, Canada

[73] Assignee: Dynamotive Corporation, Vancouver, Canada

[21] Appl. No.: 157,386

[22] Filed: Nov. 23, 1993

[51] Int. Cl.[6] ..... C25F 1/04; C25F 3/02; C25D 5/20; B08D 3/12

[52] U.S. Cl. ..... 205/148; 204/129.7; 204/141.5; 204/222; 204/273; 204/237; 204/207; 134/1

[58] Field of Search ..... 204/222, 273, 275, 237, 204/129.7, 141.5, 207; 205/148; 134/1

[56] References Cited

U.S. PATENT DOCUMENTS

| | | | |
|---|---|---|---|
| 4,131,483 | 12/1978 | Iwahashi et al. | 134/1 |
| 4,178,188 | 12/1979 | Dussault et al. | 134/1 |
| 4,386,256 | 5/1983 | Inoue | 204/129.7 X |
| 4,401,479 | 8/1983 | Quick | 148/6.35 |
| 4,408,113 | 10/1983 | Inoue | 204/129.7 X |
| 4,425,204 | 1/1984 | McLaughlin | 204/273 X |
| 5,038,808 | 8/1991 | Hammond et al. | 134/1 X |
| 5,071,776 | 12/1991 | Matsushita et al. | 134/1 |

FOREIGN PATENT DOCUMENTS

| | | |
|---|---|---|
| 2700709 | 7/1977 | Germany . |
| 2030599 | 4/1980 | United Kingdom . |
| 1591197 | 6/1981 | United Kingdom . |

OTHER PUBLICATIONS

Kamat et al., Electrogalvanishing of Mild Steel Wire Using Non-Cyanide Alkaline Bath, Transactions of the Indian Institute of Metals, vol. 28, No. 2, Apr. 1975.

Walker, The Efficiency of Ultrasonic Cleaning, Plating and Surface Finishing, vol. 72, No. 1, Jan. 1985.

Goodman, 12th National SAMPE Symposium, 1967.

*Primary Examiner*—Donald R. Valentine

*Attorney, Agent, or Firm*—Jensen & Puntigam

[57] ABSTRACT

An ultrasonic agitator (10) for generating turbulence in the vicinity of elongated metal workpieces (12) such as newly formed strands of wire. The system includes a bath (14) that is filled with a cleaning solution (16). The workpiece is introduced into the bath so as to move along a predetermined path of travel. One or more transducers (20, 24) are disposed in the bath to produce ultrasonic waves in the cleaning solution. The transducers are further configured and spaced so that the focal points of the vibrations substantially coincide with the path of travel with the workpiece. The transducers are driven by a signal generator (28) that causes the transducers to vibrate at a frequency between 0.5 and 3.0 MHz. The vibrations of the transducers produce ultrasonic waves that can be used to scrub off contaminants from the surface of the workpiece.

23 Claims, 3 Drawing Sheets

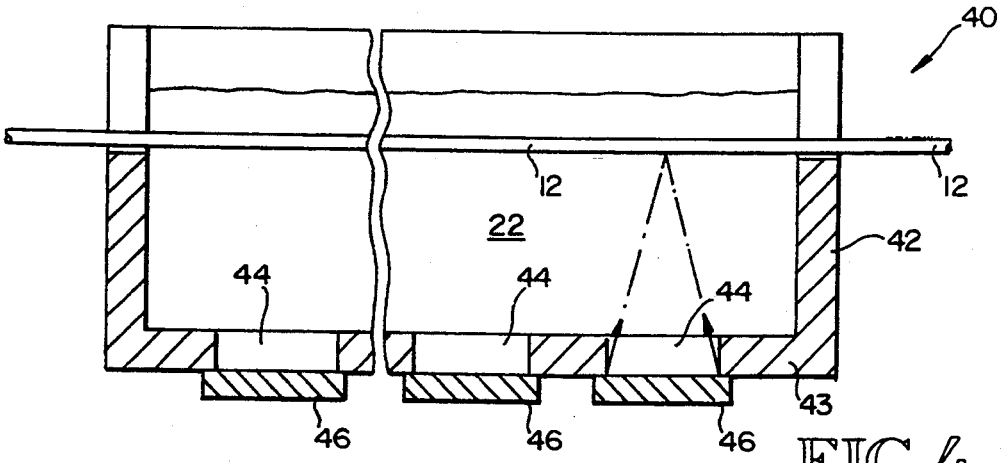
FIG. 4
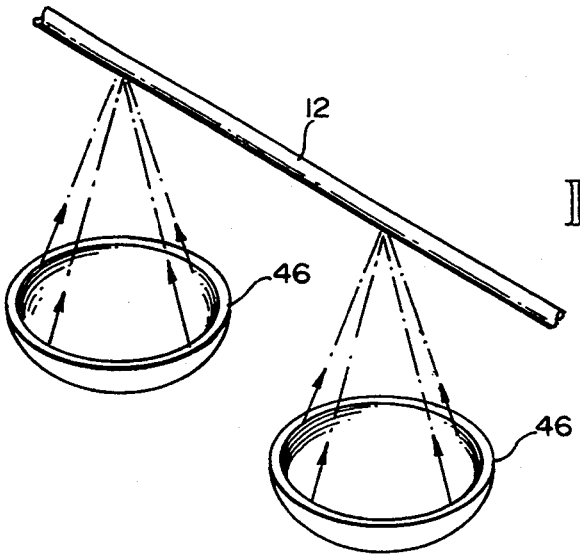
FIG. 5
FIG. 6
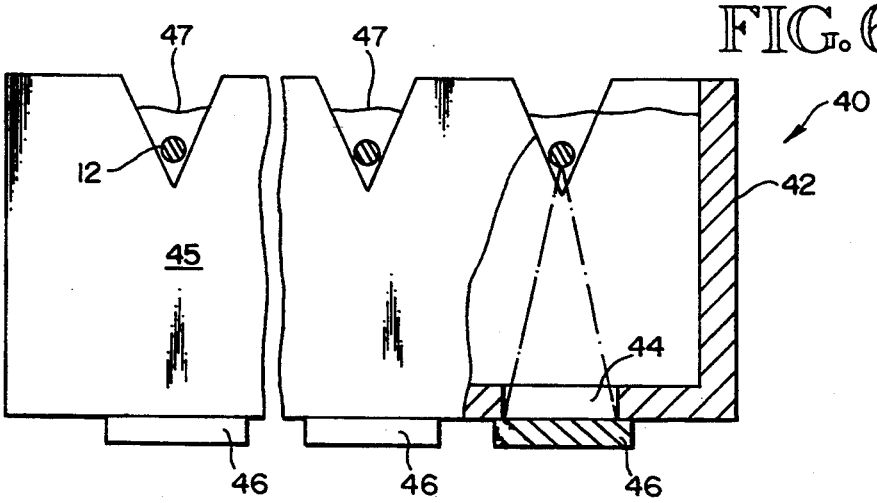

ULTRASONIC AGITATOR

TECHNICAL FIELD

This invention relates generally to a method and system of ultrasonic agitation for cleaning/treatment of workpieces and, more particularly, to a method and system for the using high frequency ultrasonic sound waves to agitate fluid in which metal workpieces such as strips or wire are immersed for the purpose of cleaning the workpieces and/or to facilitate further treatment of the workpieces.

BACKGROUND OF THE INVENTION

Ultrasonic agitators are used as cleaning systems in many industrial fields to remove contaminates such as grease, dirt, and/or shavings from a workpiece. Ultrasonic agitators, often referred to as ultrasonic cleaning systems, are used, for example, in the metal working industry to clean elongated metal workpieces, such as wire and stamped parts that are formed from stock material. Typically, ultrasonic cleaning of the workpiece occurs soon after it has been stamped, cut, or otherwise formed. In the metal working industry, the ultrasonic cleaning process is often performed as a precursor to or simultaneous with a pickling process that removes oxides that formed on the surface of the workpiece. In the metal working industry it is important to remove these oxides because their presence adversely affects the ability to bond, coat, or laminate additional layers of material to the surface of the workpiece.

Ultrasonic cleaning is currently performed by placing the workpiece in a cleaning solution which is exposed to low-frequency, 20–40 kHz, vibrations. As a consequence of these vibrations, bubbles, referred to as cavities, form in the solution. These cavities expand until they reach a resonate size at which point they implode. The implosion of the cavities creates very high local pressures and temperatures and generates shock waves within the cleaning solution. The combined effects of the development of these high pressure and temperature zones and the generation of the shock waves scrub off or at least loosen contaminants on the surface of the workpiece.

One such ultrasonic cleaning system is disclosed in German Patent Application No. 27 00 09.6. This document describes an ultrasonic cleaning system wherein a transducer with a cylindrical profile that is between 60 and 300 cm long is used to generate ultrasonic waves in a bath filled with cleaning solution. Great Britain Patent No. 1,591,197 and U.S. Pat. No. 4,401,479 disclose how cylindrical transducers are used to generate sound waves to clean a continuously moving metal wire or strip. Great Britain Patent Application No. 2 030 599 describes an ultrasonic cleaning system in which the workpieces are placed in direct contact with the ultrasonic transducers located within a bath. Once so immersed, contaminates are removed from the workpieces by their direct mechanical vibration and by the cavitation of the surrounding cleaning solution.

While current ultrasonic cleaning systems have proven effective in many environments, they are not without limitations. For example, in the wire industry, multiple parallel wires are often simultaneously produced from the same stock material. A separate ultrasonic transducer system must be provided to generate the requisite sound waves needed to clean each strand of wire. To date, it has proved both difficult and expensive to provide the requisite individual transducers. Furthermore, at the time these wires need to be cleaned, they are travelling at relatively fast speeds, for example, speeds of 50–600 feet per minute or more. To clean these wires ultrasonically, it is usually necessary to immerse them in the vibrating solution for an extended amount of time. Owing to the rate at which these wires move, it has thus become necessary to immerse them in relatively long baths in order to ensure that they are thoroughly cleaned. Still another disadvantage with ultrasonic cleaning systems is that either the transducers themselves, or the transducers in combination with complementary reflectors, completely cover the workpieces they are intended to clean. This makes it very difficult to observe and repair breaks in the workpieces such as wire breaks.

Owing to the difficulties associated with ultrasonic cleaning systems, there have been attempts to find substitute cleaning systems. There have been attempts to use cleaning systems in the form of baths that contain organic solvents at elevated temperatures. Some of the disadvantages of these systems include the necessity of large-sized baths, high operating costs, and the production of waste effluent that must be handled carefully and that is expensive to dispose.

DISCLOSURE OF THE INVENTION

Accordingly, this invention is an ultrasonic agitator that is well suited for cleaning and/or further treatment of elongated metal workpieces, such as newly formed wire. The ultrasonic agitator of this invention includes: a bath in which the workpiece is disposed; a fluid in the bath wherein the bath is filled to the point where the workpiece is immersed by the fluid; one or more focused ultrasonic transducers which are arranged to produce ultrasonic waves that converge toward and are focused on the workpiece; and a drive circuit for exciting the transducers so that they vibrate at relatively high frequencies.

It is still another feature of this invention that the agitator is constructed to have a first, open-ended overflow bath that is seated in a collecting bath. The transducers are mounted in the overflow bath. A pumping system connects the baths so that fluid that flows through the ends of the overflow bath is contained in the collecting bath, and pumped back into the overflow bath. The workpiece is passed through the open end of the overflow bath. The action of the pumping system ensures that while the workpiece moves through the overflow bath, the workpiece remains immersed by the ultrasonically vibrating fluid.

While it is clear that the ultrasonic agitator of this invention can be used to foster the cleaning of the workpiece, it can also be used to generate a turbulent fluid flow adjacent the workpiece in order to accomplish other tasks. For example, the ultrasonic agitator of this invention can be used to generate a turbulent fluid flow adjacent a workpiece in order to foster the electropickling or electroplating of the workpiece.

BRIEF DESCRIPTION OF THE DRAWINGS

The invention is pointed with particularly in the appended claims. The above and further features of this invention may be understood by reference to the specification and the accompanying drawings in which:

FIG. 4 is a longitudinally extending view of alternative ultrasonic agitator of this invention;

FIG. 5 is a perspective view of the relationship of the transducers of FIG. 4 to the associated wire workpieces;

FIG. 6 is a laterally extending, partial cross-sectional view of the ultrasonic agitator of FIG. 4;

BEST MODE FOR CARRYING OUT THE INVENTION

Figure 1:
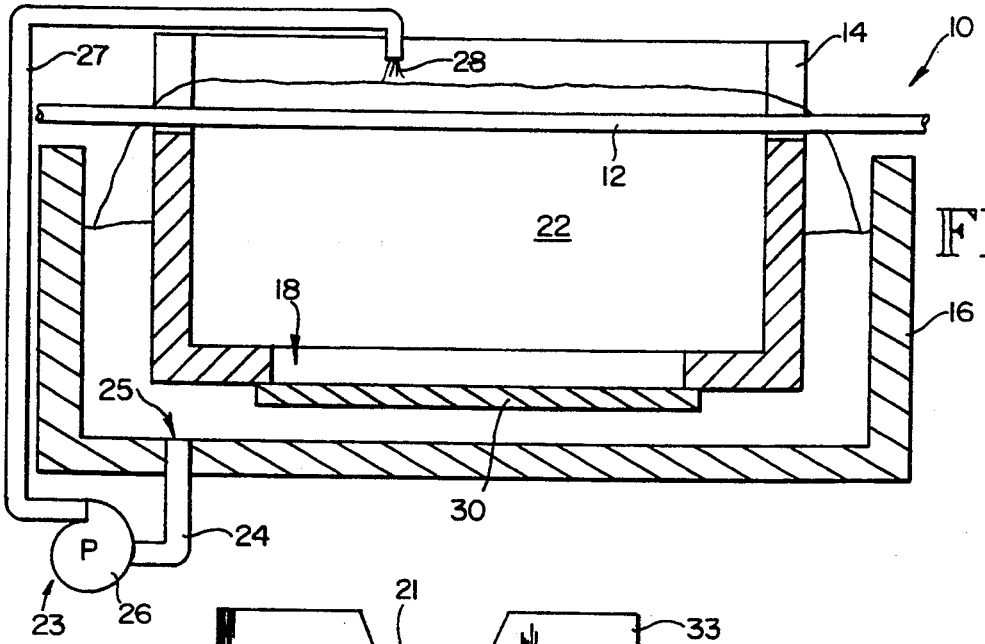
FIG. 1 is a cross-sectional longitudinal view of one version of the ultrasonic agitator of this invention.
Figure 2:
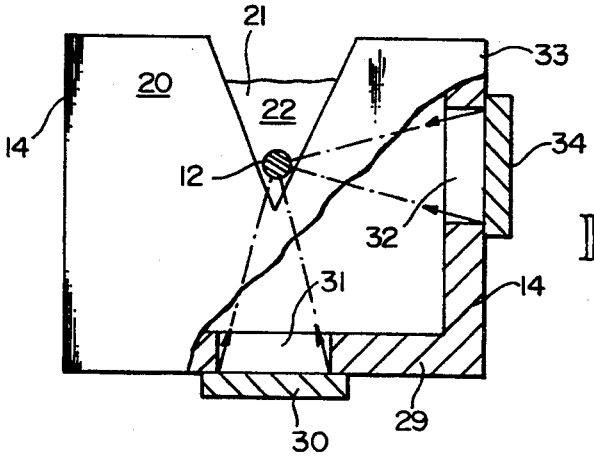
FIG. 2 is a laterally extending partial cross-sectional view of the ultrasonic agitator of FIG. 1.

FIGS. 1 and 2 illustrate a basic ultrasonic agitator 10 constructed in accordance with this invention that is used for cleaning a workpiece 12, such as a strand of wire. Agitator 10 includes a first, overflow bath 14 through which workpiece 12 travels that is seated in a second, larger, collecting bath 16. As seen best by reference to FIG. 1, the overflow bath 14 is positioned in the collecting bath 16 so that the top walls of the overflow bath 12 extend above the top of the collecting bath 16. As seen by reference to FIG. 2, the overflow bath 14 is formed with a pair of end walls 20, one shown, that are shaped to have indentations 21 through which the workpiece 11 moves in or out of the bath 14 immediately above the top of the collecting bath 16. A suspension assembly, such as a pair of guide rollers, not illustrated, located on either side of the agitator, holds the workpiece 12 stable so that it travels along a generally linear path of travel through the overflow bath 14. The suspension assembly also holds the workpiece stable so that it does not contact the edges of the overflow bath end walls 20 that form the indentations 21.

The baths 14 and 16 are filled with a cleaning solution 22 such as water. Normally, the cleaning solution in the overflow bath 14 flows out of the end wall indentions 21 and into the collecting bath 16 below. A pumping system 23 is provided to recirculate the cleaning solution so that, as the workpiece 12 travels through the overflow bath 14, it is immersed in the cleaning solution. The pumping system 23 includes an outlet line 24 which is coupled to a drain 25 in the base of the collecting bath 16. The opposed end of the outlet line 24 is coupled to a pump 26 that forces the solution 22 through a return line 27. The return line is formed with a discharge port 28 that is positioned adjacent the top of the overflow bath 14. More specifically, pump 26 is selected and discharge port 28 is positioned so that when the cleaning solution 22 is returned to the overflow bath 14, the solution will substantially immerse the workpiece 12 as it travels through the bath 14. Although FIGS. 1 and 2 illustrate an overflow bath embodiment, it should be understood that other embodiments could be devised which permit a rapid movement of wire and maintain the wire in an immersed state.

The overflow bath 14 has a bottom or base section 29 that defines an opening 31. An ultrasonic transducer 30 is sealingly attached to the bottom surface of the bath base section 29 so as to be positioned underneath opening 31. As best seen in FIG. 2, the bath 14 is also formed with sidewalls 33, one of which may be formed with an opening 32. A second ultrasonic transducer 34 is secured to the outside of the sidewall 33 so as to cover the opening 32. Either a bottom transducer, a side transducer or both may be used.

Figure 3:
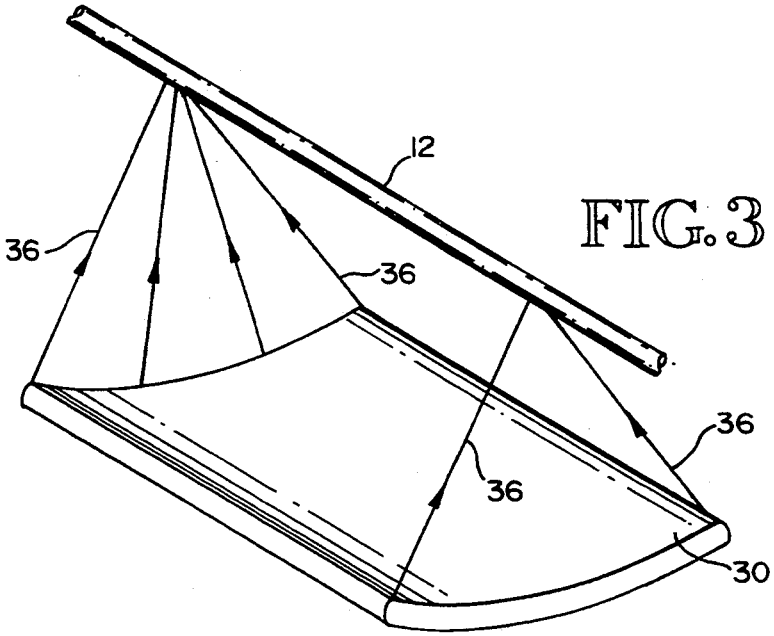
FIG. 3 is a perspective view illustrating the relationship of a transducer to an associated wire workpiece.

Transducers 30 and 34 are, for example, formed of piezoelectric, piezomagnetic or electromagnetic material, such that when they are supplied with a drive potential from signal generator 36, they generate ultrasonic waves. Transducers 30 and 34 are generally of the type that produce ultrasonic waves that inwardly converge. This feature of the invention is illustrated by FIG. 3 which depicts transducer 30 as having a parabolic cross-sectional profile. Since transducer 30 has an elongated shape, the ultrasonic waves produced as a consequence of the vibrations of the transducer converge along an elongated focal line. As further shown by FIG. 3, the workpiece 12 is positioned in the bath so that its path of travel substantially intersects with the focal lines of both transducers 30 and 34. While FIG. 3 illustrates a parabolic-shaped transducer, a typical embodiment might include circular, flat transducers, such as shown for example in FIGS. 1 and 2, as well as in FIG. 5. Such a "flat" transducer is still capable of producing a convergent and substantially focused beam.

The ultrasonic agitator 10 of this invention is used to clean the workpiece 12 by energizing transducers 30 and 34 while the workpiece is passed through the overflow bath 14. The vibration of transducers 30 and 34 induces high-frequency ultrasonic waves in the solution 22. In one particular version of the invention, the transducers are excited to vibrate at a frequency between 100 kHz and 6 MHz and, more particularly, between 500 kHz and 3 MHz. The ultrasonic waves produced in the cleaning solution converge inward, as represented by arrows 36 (FIG. 3), on the path of travel of the workpiece 12. Consequently, the maximum acceleration of the waves formed in the cleaning solution 22 is in the vicinity of the outer surface of the workpiece 12. This rapid, transducer-induced turbulence of the cleaning solution 22 loosens and dislodges solid and semi-solid contaminants from the surface of the workpiece 12. As a result, the workpiece leaves the agitator 10 with a relatively clean surface.

Since the focus of the ultrasonic waves intersects the path of travel of the workpiece 12, cleaning solution 22 efficiently scrubs contaminants off the workpiece. Workpiece 12 does not have to be exposed to the agitated cleaning solution for an extended period of time to be thoroughly cleaned. Thus, this agitator 10 is well suited for cleaning a rapidly moving workpiece 12, such as a newly formed wire segment, since the workpiece need only be immersed in a bath that has a relatively short overall length. For example, a wire moving at a rate of approximately 5 feet per second need only be immersed in the agitated cleaning solution for only approximately 1 to 2 seconds. Thus, the wire workpiece 12 need only travel through overflow bath 14 constructed in accordance with the agitator 10 of this invention that is approximately 0.5 to 1.0 feet long in order to be thoroughly cleaned.

Still another feature of this invention is that owing to the intensity of the motion of the cleaning solution 22, it is not necessary to surround the workpiece 12 with a large circumferential volume of cleaning solution 22. In most preferred embodiments of the invention, the workpiece can be cleaned in an overflow bath 14 that is filled to a depth of six inches or less of cleaning solution, and more particularly, in a bath 14 that usually has two inches or less of cleaning solution. The small depth of requisite cleaning solution 22 and the relatively short overall length of the overflow bath 14 keep the volume of cleaning solution 22 required to fill the bath to a minimum. Since agitator 10 of this invention requires only a small amount of cleaning solution 22, the costs of supplying, recirculating, and filtering the solution are similarly reduced.

Still another feature of the ultrasonic agitator 10 of this invention is that the transducers 30 and 34 do not completely surround the associated workpiece 12 and the transducers do not need to be provided with complementary wave reflectors. Thus, the workpiece 12 remains exposed while it passes through the agitator 10 so as to facilitate its quick visual inspection and easy repair in the event of separation or breakage.

Another feature of agitator 10 is that the workpiece 12 enters and leaves the immersing bath, overflow bath 14, directly through the indentations 21. The workpiece does not have to travel over a non-linear path in order to be immersed or removed from the bath. Thus, any need to bend the workpiece in order to ultrasonically clean it is eliminated. This feature also eliminates the need to introduce the workpiece into the bath or remove it therefrom through seals fitted in the sides of the bath. The elimination of these seals eliminates having to change them either due to where or when there is need to send a workpiece with a different diameter through the agitator 10. Moreover, since the workpiece does not have to pass through the seals, its rate of travel is not slowed or otherwise disrupted by the friction contact to which it would otherwise be exposed.

FIGS. 4–6 illustrate an alternative ultrasonic agitator 40 of this invention. Agitator 40 includes a bath 42 through which the workpiece 12 travels. Bath 42 is similar in structure to the previously described overflow bath 14 and is seated in a collecting bath, not illustrated, that is similar in structure and function to previously described collecting bath 16. The bath 40 is filled with cleaning solution 22. As seen best by FIG. 4, bath 42 has a base, bottom panel 43, that is formed with a number of longitudinally spaced openings 44. Individual ultrasonic transducers 46 are attached to the undersurface of bottom panel 43 below each opening 44.

Transducers 46 have a circular shape and are of the type that generate ultrasonic waves that converge on a focal point. As shown diagramatically by FIG. 5, wherein the transducers are shown as having a parabolic profile, the transducers are secured to bath 42 so that their focal points generally intersect the path of travel of the workpiece 12 through the bath 42.

As seen by FIG. 6, ultrasonic agitator 40 is further designed to clean a multiple number of workpieces 12 simultaneously. Each workpiece travels along a distinct path of travel through the bath, the individual paths of travel being generally in the form of parallel lines that are spaced apart from each other. The bath 42 is formed so that there are a number of laterally spaced openings 44, one set of openings under the path of travel of each workpiece 12. Separate linearly aligned transducers 46 are attached to the undersurface of the bath bottom panel 43, one under each opening 44.

To minimize the rate at which the cleaning solution 22 overflows from bath 42 into the complementary collecting bath, bath 42 includes a pair of opposed end walls 45 that are formed with a plurality of indentations 47 through which the individual workpieces enter and leave the bath. End walls 45 are shaped so that the indentations 47 are aligned with the transducers 46 fixed to the bottom panel 43 of the bath 42.

The circular transducers 46 of the ultrasonic agitator 40 of this invention generate very intense ultrasonic waves which converge on spaced-apart points or small areas on the path of travel of the workpiece 12. The motions induced in the cleaning solution 22 near these focal areas are located around the outer surface of the workpiece. As a result, the cleaning solution 22 performs a very intense scrubbing action against the workpiece 12 which vigorously loosens and breaks off contaminants from the outer surface of the workpiece.

The ultrasonic agitator 40 of this version of the invention is also capable of simultaneously cleaning multiple workpieces 12 with only a marginal increase in the overall size and cost of the agitator. In particular, when the agitator is used to clean multiple wire workpieces 12, the individual wires need only be positioned in the bath 42 so that their individual paths of travel are only approximately 0.5 to 1.0 inches apart from each other.

Figure 7:
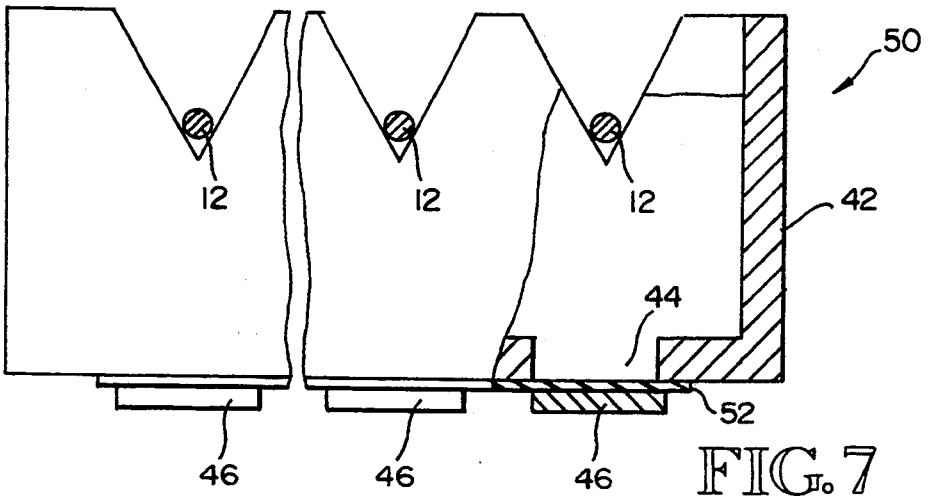
FIG. 7 is a longitudinal, laterally extending, partial cross-sectional view of another alternative ultrasonic agitator of this invention.

FIG. 7 illustrates an alternative ultrasonic agitator 50 of this invention. Agitator 50 includes the basic bath 42 previously described with respect to ultrasonic agitator 40. In this version of the invention, the transducers 46 are attached to the undersurface of a diaphragm 52 that is bonded or otherwise secured to the undersurface of the bath bottom panel 43.

Figure 8:
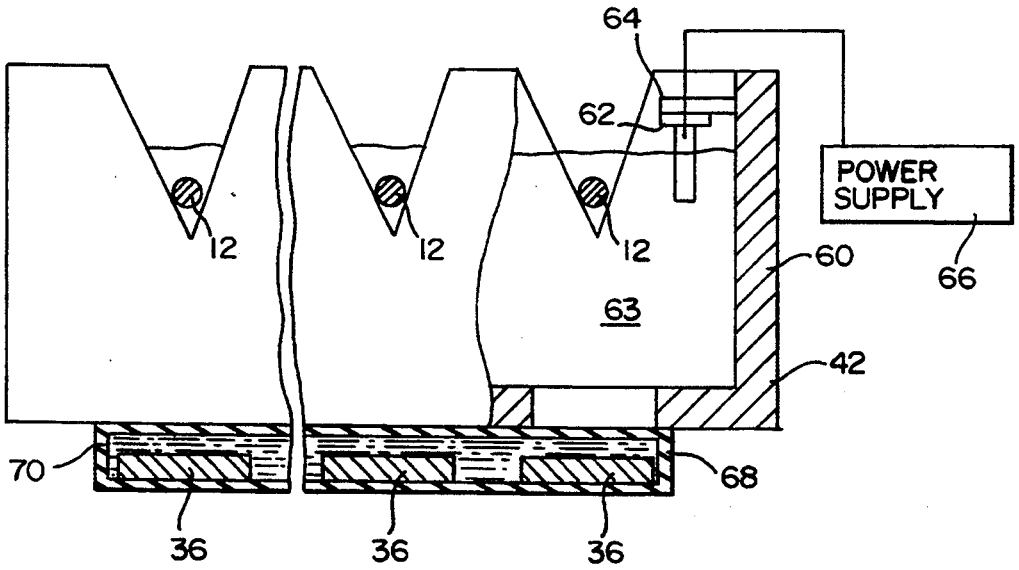
FIG. 8 is a partial cross-sectional view of another ultrasonic agitator of this invention designed to function as either an electropickling system or an electroplating system.

FIG. 8 illustrates an alternative ultrasonic agitator 60 of this invention that is used in electrolytic applications, such as to electropickle or electroplate a workpiece 12. Agitator 60 incorporates the previously described bath 42. An electrolysis electrode 62 is attached to the side of the bath 42 by a bracket 64. Agitator 60 also includes a brush system or other device known in the art for applying a potential to the individual workpieces 12, brush system not illustrated. When agitator 60 is employed to electropickle a workpiece 12, the bath 42 is filled with a liquid 63 such as salt walter that, in addition to having desirable scrubbing capabilities, also functions as an electrolyte. A power supply 66 is used to develop a potential between the workpiece 12 and the electrode 62.

The transducers 46 are isolated from the electrolyte 63 by a sealed diaphragm 68 to prevent their corrosion by the electrolyte. The diaphragm 68 is mounted to the base of bath bottom panel 43. The transducers are mounted to a holding tray 59 seated in the bottom of the diaphragm 68. The void space in the diaphragm 68 not otherwise occupied by the transducer 46 is filled with a fluid 70, such as distilled water or oil, which has the desirable property of functioning as a medium through which the movement of the transducers can be transmitted through the wall of the diaphragm 68 and into the electrolytic solution 63.

An advantage of the ultrasonic cleaning agitator 60 is that the sealed diaphragm 68 thoroughly protects the transducer 46 contained therein. Moreover, agitator 60 creates turbulence in the vicinity of the workpiece 12 while the workpiece is electropickled. An advantage of performing these processes together is that the electropickling and the cleansing action are both enhanced by the agitation of the electrolytic cleaning solution 63 in the vicinity of the workpiece.

Agitator 60 can alternatively be used to foster the electroplating of the workpiece 12. When the agitator 60 is used for this process, the bath 42 is filled with an electroplating liquor as opposed to the previously described electrolyte. The electroplating is performed by simultaneously activating the power supply 66 to develop a potential across the workpiece 12 and the electrode 62, while simultaneously exciting the transducers 46. The generating of a turbulent fluid flow in the vicinity of the workpiece 12 during the electroplating process increases the flow of metal-containing ions to the surface of the workpiece. This serves to improve the quality of the electrodeposits and increase the speed of the electrodeposition over normal levels.

It should be understood that the foregoing description is for the purposes of illustration only. It will be apparent that variations and modifications can be made to this invention with the attainment of some or all of the advantages thereof. For example, in some versions of the invention, the end walls of the overflow bath may not have the illustrated V-shaped indentations. For instance, in some versions of the invention, the system end walls may be formed with openings that have diameters substantially larger than that of the workpieces which serve as ports through which the workpiece is introduced into and withdrawn from the agitator. The advantage of such construction is that it reduces the rate at which the fluid flows out of the overflow bath and into the collecting bath.

Moreover, some versions of the agitator may only have a single bath. In these versions of the invention, it would be necessary to introduce the workpiece into the bath through seals or similar elements formed in the sides of the bath or by dipping the workpiece in the top of the bath, moving it longitudinally across the bath so that it intersects the focal point(s) of the transducer(s), and then removing it from the top of the bath. In these latter versions of the invention, it may be desirable to provide the agitator with a set of rollers that serve to guide the workpiece so that it progresses along a path of travel that intersects the transducer focal points. Other versions of the invention may be provided where a stand or support is provided to hold the workpiece in a substantially static location that intersects with the area in which the ultrasonic waves produced in the cleaning solution by the transducer converge. It may also be desirable to provide one or more moving transducers that periodically focus sound waves at different locations around the outer surface of the workpiece.

In still other versions of the invention, it may be desirable to provide heating elements inside the bath in order to raise the temperature of the cleaning solution to increase its effectiveness to loosen and separate contaminants from the workpiece. In some versions of the invention, it may only be necessary to provide only a single elongated transducer 30 to fully clean a workpiece. Furthermore, it should be recognized that the actual type of cleaning performed by the agitator of this invention may vary depending on the nature of the workpiece and the cleaning solution in which it is immersed. For example, in addition to being used to foster the electropickling or electroplating of the workpiece, the agitator could be used to aid in the electrodelamination of a workpiece, which is the removal of an electrically conductive solid substrate. It shall also be recognized that there may be times when the agitator of this invention is used to foster the electropickling or electroplating of a workpiece where the liquid, such as the electroplating liquor used in conjunction with the process, will not adversely affect the transducers. In these versions of the invention, it may not be necessary or even desirable to encase the transducers in a diaphragm.

Therefore, it is the object of the appended claims to cover all such variations and modifications, in the true spirit and scope of the invention.

We claim:

1. An ultrasonic agitator for exposing a workpiece to a turbulent fluid flow, including:

a first bath in which the workpiece is disposed at a selected location;

a fluid adapted to be disposed in said first bath, wherein in operation of the agitator, the workpiece is immersed in said fluid;

a transducer connected to said first bath so as to be in mechanical communication with said fluid, said transducer being configured to produce ultrasonic waves in said fluid and shaped and positioned so as to produce converging waves in said fluid that converge at a focal point that substantially coincides with said selected location at which the workpiece is positioned; and a transducer drive system connected to said transducer for causing said transducer to vibrate at a frequency of at least 500 kHz so that said drive system causes the formation of waves that converge at said selected location at which the workpiece is located so as to produce a turbulent fluid flow adjacent the workpiece.

2. The ultrasonic agitator of claim 1, wherein said fluid is an electroplating liquor, and wherein the agitator includes means for creating a potential between the workpiece and an electrode so as to electroplate the workpiece.

3. The ultrasonic agitator of claim 1, wherein said solution is an electrolytic solution, and wherein the agitator includes means for creating a potential between the workpiece and an electrode so as to electropickle the workpiece.

4. The ultrasonic agitator of claim 1, wherein the workpiece is in the form of an elongated member having a longitudinal axis and said transducer is in the form of an elongated member having a longitudinal axis with a laterally extending cross-section profile so that said waves produced in said fluid converge along a focal line.

5. The ultrasonic agitator of claim 1, wherein:

said first bath is an overflow bath, said overflow bath having a pair of end walls, said end walls being formed with indentations through which the workpiece is introduced into and removed from said overflow bath, said end walls being shaped so that the workpiece is introduced into and removed from said overflow bath without substantially contacting said end walls, and said agitator further includes:

a second, collecting bath located below said overflow bath and positioned to receive said fluid drained from said overflow bath; and a pumping system connected between said collecting bath and said overflow bath for returning said fluid from said collecting bath to said overflow bath, said pumping system having a discharge port positioned to discharge said fluid so that said workpiece is immersed in said fluid.

6. The ultrasonic agitator of claim 1, wherein the workpiece is in the form of an elongated member that moves along a path of travel through said first bath, and said transducer is in the form of an elongated member that produces ultrasonic waves in said fluid that converge along a focal line, and said transducer is secured to said first bath so that the focal line of said waves substantially coincides with said path of travel of the workpiece.

7. The ultrasonic agitator of claim 6, wherein said transducer drive system vibrates said transducer at a frequency between 500 kHz and 3 Mhz.

8. The ultrasonic agitator of claim 1, wherein the workpiece is in the form of an elongated member that moves along a path of travel through said fluid, and said agitator further includes a plurality of transducers, said transducers being of the type that produce ultrasonic waves in said fluid that converge on a focal point, and said transducers are secured to said first bath so that the focal points of said waves substantially coincide with said path of travel of the workpiece.

9. The ultrasonic agitator of claim 8, wherein said transducers are positioned so that the focal points of said waves coincide with spaced-apart points along said path of travel of the workpiece.

10. The ultrasonic agitator of claim 8, wherein said transducer drive system vibrates said transducers at a frequency between 500 kHz and 3 MHz.

11. An ultrasonic agitator for exposing a workpiece to a turbulent fluid flow, said workpiece moving along a preestablished path of travel, said agitator including:

an overflow bath, said overflow bath having a pair of end walls, said end walls being formed with openings through which the workpiece is introduced into and removed from said overflow bath when the workpiece is moved along the path of travel, said end walls being shaped so that the workpiece moves along the path of travel without substantially contacting said end walls;

a fluid adapted to be disposed in said overflow bath, said fluid being of a sufficient volume to substantially immerse the workpiece and flow out of said overflow bath through said end wall openings;

at least one transducer secured to said overflow bath to ultrasonically vibrate said fluid therein;

a collecting bath located below said overflow bath and positioned to receive said fluid that flows out of end wall openings of said overflow bath; and a pumping system connected between said collecting bath and said overflow bath for returning said fluid from said collecting bath to said overflow bath, said pumping system having a discharge port positioned to discharge said fluid so as to continually immerse the workpiece in said fluid.

12. The ultrasonic agitator of claim 11, wherein said end walls of said overflow bath are shaped to define open-ended openings.

13. A method of subjecting an elongated metal workpiece to a turbulent fluid flow, including the steps of:

immersing the workpiece in a fluid, moving the workpiece through said fluid along a preselected path of travel, and removing the workpiece from said fluid; and generating ultrasonic waves in said fluid as the workpiece travels through said fluid, said ultrasonic waves being generated so as to converge toward at least one point along said workpiece path of travel and being generated to have a frequency of at least 500 kHz so that said waves induce a turbulent fluid flow in said fluid adjacent the workpiece.

14. The method of claim 13, wherein said ultrasonic waves are generated at two locations in said bath and are generated so as to converge at least two separate focal points in said bath, each said focal point being at a location that substantially corresponds to said path of travel of the workpiece.

15. The method of claim 13, wherein said fluid is an electrolytic solution, and further including the step of creating a potential between the workpiece and an electrode in contact with said electrolytic solution so as to electropickle the workpiece.

16. The method of claim 13, wherein said fluid is an electroplating liquor, and further including the step of creating a potential between the workpiece and an electrode in said electroplating liquor so as to electroplate the workpiece.

17. The method of claim 13, wherein said fluid is a solution for cleaning the workpiece, and the ultrasonic waves produce a cleaning of the workpiece.

18. An ultrasonic agitator for exposing a workpiece to a turbulent fluid flow, including:

an overflow bath having a pair of end walls, said end walls being formed with at least one indentation through which the workpiece is introduced into and removed from said overflow bath, said end wall being shaped so that said workpiece is introduced into and removed from said overflow bath without substantially contacting said end walls;

a fluid adapted for disposal in said overflow bath, wherein in operation of the agitator, the workpiece is immersed in said fluid;

a collecting bath located below said overflow bath and positioned to receive said fluid drained from said overflow bath;

a transducer connected to said overflow bath so as to be in mechanical communication with said fluid, said transducer being configured to produce ultrasonic waves in said fluid;

a transducer drive system connected to said transducer to vibrate said transducer; and a pumping system connected between said collecting bath and said overflow bath for returning said fluid from said collecting bath to said overflow bath, said pumping system having a discharge port positioned to discharge said fluid into said overflow bath so that said workpiece is immersed in said fluid.

19. The ultrasonic agitator of claim 18, wherein said overflow bath end walls are formed with a first indentation through which the workpiece is introduced into said overflow bath and a second indentation through which the workpiece is removed from the overflow bath.

20. The ultrasonic agitator of claim 18, wherein the workpiece is in the form of an elongated member that moves along a path of travel through said overflow bath, and said transducer is in the form of an elongated member that produces ultrasonic waves in said fluid that converge along a focal line, and said transducer is secured to said first bath so that the focal line of said waves substantially coincides with said path of travel of the workpiece.

21. The ultrasonic agitator of claim 18, wherein the workpiece is in the form of an elongated member that moves along a path of travel through said fluid, and said agitator further includes a plurality of transducers, said transducers being of the type that produce ultrasonic waves in said fluid that converge on a focal point, and said transducers are secured to said first bath so that the focal points of said waves substantially coincide with said path of travel of the workpiece.

22. A method of subjecting an elongated metal workpiece to a turbulent fluid flow, including the steps of:

immersing the workpiece in an electrolytic solution, moving the workpiece through said solution along a preselected path of travel, and removing the workpiece from the solution;

generating ultrasonic waves in said electrolytic solution as the workpiece travels through said solution, said ultrasonic waves being generated so as to converge toward at least one point along said workpiece path of travel and further being generated to have a frequency of at least 500 kHz; and creating a potential between the workpiece and an electrode in contact with said electrolytic solution so as to electropickle the workpiece.

23. A method of subjecting an elongated metal workpiece to a turbulent fluid flow, including the steps of:

immersing the workpiece in an electroplating liquor, moving the workpiece through said electroplating liquor along a preselected path of travel, and removing the workpiece from the electroplating liquor;

generating ultrasonic waves in said electroplating liquor as the workpiece travels through said solution, said ultrasonic waves being generated so as to converge toward at least one point along said workpiece path of travel and further being generated to have a frequency of at least 500 kHz; and creating a potential between the workpiece and an electrode in contact with said electroplating liquor so as to electroplate the workpiece.

* * * * *